United States Patent [19]

Bidanset

[11] Patent Number: 4,834,784

[45] Date of Patent: May 30, 1989

[54] AIR FILTER CHOKE VALVE METHOD AND SPITBACK SHIELD

[75] Inventor: Edward J. Bidanset, Charlotte, N.C.

[73] Assignee: Textron, Inc., Providence, R.I.

[21] Appl. No.: 241,072

[22] Filed: Sep. 6, 1988

[51] Int. Cl.[4] ..... F02M 1/02

[52] U.S. Cl. ..... 55/385.7; 55/464; 55/417; 55/419; 55/DIG. 28; 261/64.6

[58] Field of Search ..... 55/385.1, 385.7, 464, 55/419, 417, DIG. 28; 261/64.6

[56] References Cited

U.S. PATENT DOCUMENTS

| | | | |
|---|---|---|---|
| 1,105,090 | 7/1914 | Metzger | 261/64.6 |
| 1,885,331 | 11/1932 | Collins | 261/64.3 |
| 1,968,553 | 7/1934 | Heitger | 261/39.3 |
| 2,717,150 | 9/1955 | Agar | 261/64.6 |
| 2,868,322 | 1/1959 | Stauffer | 55/DIG. 28 |
| 3,224,174 | 12/1965 | Erbstoesser | 55/DIG. 28 |
| 3,382,853 | 5/1968 | Kinoshita | 123/73 |
| 3,746,320 | 7/1973 | Van Camp et al. | 261/35 |
| 3,811,417 | 5/1974 | Keenan et al. | 123/73 A |
| 3,849,093 | 11/1974 | Konishi et al. | 55/385.1 |
| 3,852,377 | 12/1974 | Heintzelman et al. | 261/1 |
| 3,856,490 | 12/1974 | Heintzelman | 55/420 |
| 3,927,656 | 12/1975 | Reed et al. | 55/DIG. 28 |
| 4,317,663 | 3/1982 | Dollar | 55/DIG. 28 |
| 4,366,104 | 12/1982 | Miller | 261/18 A |
| 4,495,911 | 1/1985 | Andreasson | 123/198 R |
| 4,539,162 | 9/1985 | Ferrell | 261/1 |
| 4,600,418 | 7/1986 | Gommel et al. | 55/462 |
| 4,648,474 | 3/1987 | Shinozaki et al. | 180/219 |
| 4,691,681 | 9/1987 | Hoppner et al. | 123/556 |

FOREIGN PATENT DOCUMENTS 65546 12/1982 European Pat. Off. .

OTHER PUBLICATIONS

Homelite Parts List for Models 290 and 340 Chain Saws; p. 6, Part No. 17867.

Jonsered Spare Parts List for Model 590 Chain Saw; 1987; p. 4.

Copy of Photographs of Jonsered Chain Saw Air Filter and Movable Choke.

*Primary Examiner*—Tim Miles

*Attorney, Agent, or Firm*—Perman & Green

[57] ABSTRACT

An airflow controller for use in an air filter for an internal combustion engine. The airflow controller comprises a frame and means for movably mounting the frame in the air filter for relatively lateral movement therein. The airflow controller frame comprises a plate that can restrict airflow into a carburetor to choke an engine and a spitback shield having an air intake volute and a venturi cone.

22 Claims, 3 Drawing Sheets

AIR FILTER CHOKE VALVE METHOD AND SPITBACK SHIELD

BACKGROUND OF THE INVENTION

1. Field of the Invention

This invention relates to internal combustion engines and, more particularly, to an air filter having a choke valve and spitback shield.

2. Prior Art

Various different types of choke valves and spitback shields are known in the internal combustion engine art. In Andreasson, U.S. Pat. No. 4,495,911 a choke device located in the air filter of an internal combustion engine is disclosed. U.S. Pat. No. 1,105,090 discloses an air valve for carburetors. U.S. Pat. No. 4,539,162 discloses a choke assembly for a golf cart. U.S. Pat. No. 3,746,320 discloses a fuel feed and charge forming method and apparatus with an inlet region having a choke band of a venturi-like shape.

However, various different problems still exist with presently available devices. First, it is desirous to substantially reduce or eliminate contamination of the filter elements in the air filter by fuel spitback. Spitback can generally be described as the ejection of fuel particles out of the carburetor air intake into the air filter. Spitback can contaminate the air filter element causing dust particles and the like to become caked on the filter elements and prevent a proper air-fuel mixture from being obtained. Second, in some situations, it is desirous to provide components as small or compact as possible such as for reduction in the size and weight of the engine. This is particularly important for hand held devices such as chain saws or grass trimmers.

It is therefore an objective of the present invention to provide an air filter having an airflow controller that is laterally movably mounted in the air filter for a relatively small and compact combined air filter and airflow controller.

It is a further objective of the present invention to provide an airflow controller for use in an air filter that can restrict airflow into carburetor and also act as a spitback shield to protect the filter element of the air filter.

SUMMARY OF THE INVENTION

The foregoing problems are overcome and other advantages are provided by an airflow controller for use in an air filter for an internal combustion engine.

In accordance with one embodiment of the invention, an airflow controller is provided with a frame means and means for movably mounting the frame means in an air filter. The frame means comprises a first section having a carburetor inlet restrictor means and a second section having means for directing air inflow into the carburetor inlet. The means for movably mounting the frame means provides for movement relatively lateral in the air filter between a first position having the restrictor means substantially restricting air inflow into the carburetor inlet and a second position having the directing means substantially defining an air inflow path towards the carburetor inlet.

In accordance with another embodiment of the invention, an air filter for use with a carburetor on an internal combustion engine is provided. The filter comprises a frame means, filter element means and airflow controller means movably mounted in the frame means. The airflow controller means comprises means for substantially restricting airflow into the carburetor and a spitback shield means having an air intake volute means and a venturi cone means therewith.

In accordance with one method of the invention, a method is provided for manufacturing an air filter for an internal combustion engine. The method comprises the steps of providing a filter frame means connectable to a carburetor of the engine and having an airflow inlet therewith; providing an airflow controller comprising choke valve means and air inflow channelizer means, the airflow channelizer means comprising a spitback shield having a venturi cone means and an inflow volute; and mounting the airflow controller in the filter frame proximate the airflow inlet such that the airflow controller is movably mounted in the frame means with the choke valve means being movable to choke the engine in a first position.

BRIEF DESCRIPTION OF THE DRAWINGS

The foregoing aspects and other features of the invention are explained in the following description, taken in connection with the accompanying drawing wherein.

DETAILED DESCSRIPTION OF THE INVENTION

Figure 1:
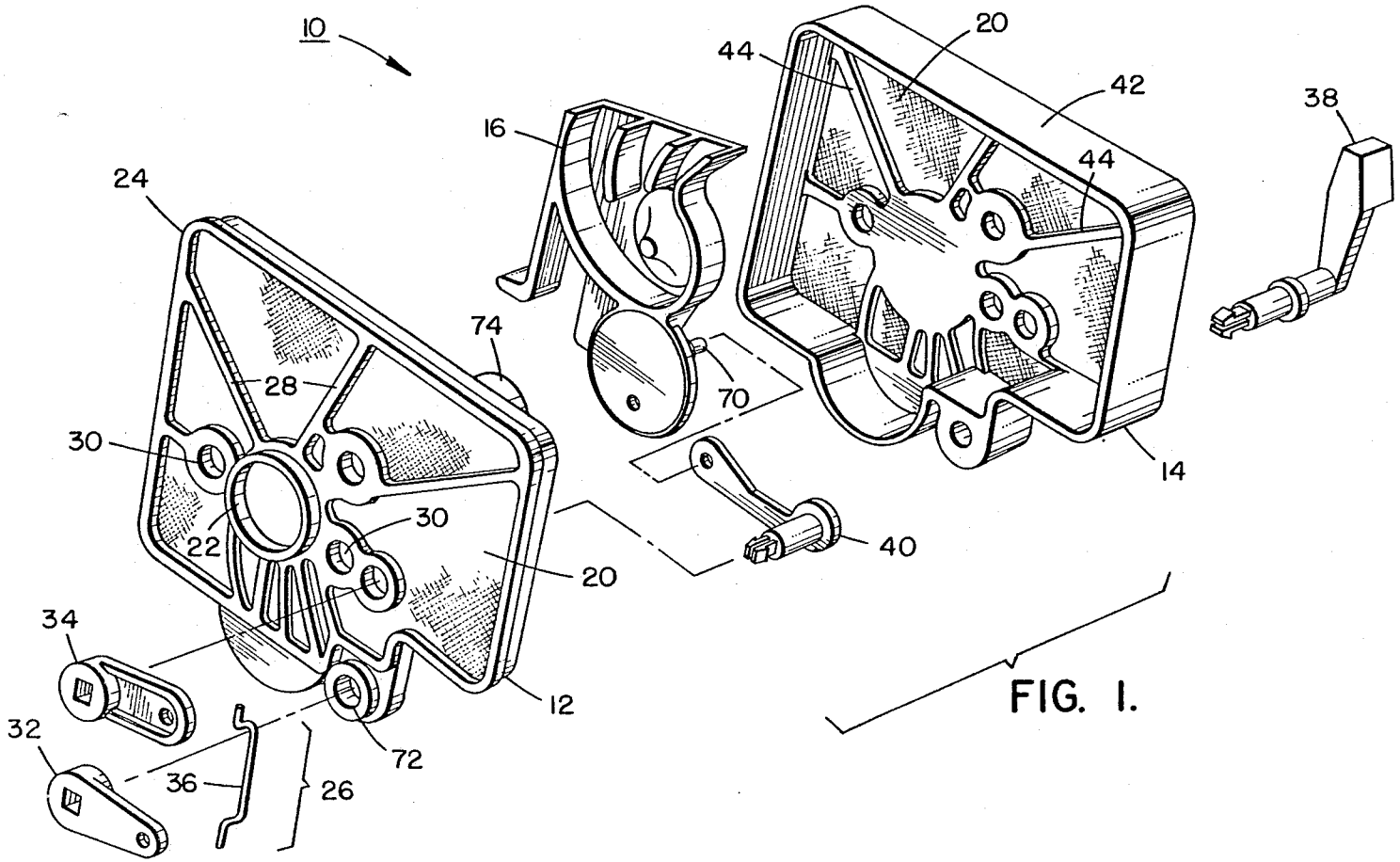
FIG. 1 is an exploded view of an air filter incorporating features of the present invention.

Referring to FIG. 1, an exploded view of an air filter 10 for use with an internal combustion engine (not shown) incorporating features of the invention is shown. Although the features of the present invention will be described in detail with regard to the embodiment shown in FIG. 1, it should be understood that the present invention can be embodied in many alternate forms and is not necessarily limited to the embodiment shown in FIG. 1. In addition, it should be understood that the present invention may include many suitable size, shape or type of materials without departing from the spirit of the invention. In addition, a cross-reference is hereby made to a co-pending patent application entitled "Improved Cartridge Air Filter" by the same inventor as herein Ser. No. 241,075, filed 9-6-88 (Attorney Docket No. 914-871945-NA) and assigned to the same assignee as herein which is incorporated by reference in its entirety herein.

The air filter 10, in this embodiment, generally comprises a filter base 12, a filter cover 14 and an airflow controller 16. The air filter 10 is generally mounted to a carburetor (not shown) of the engine wherein incoming air intended to be mixed with fuel in the carburetor is first passed through the air filter 10 which filters or removes containments from the inflowing air. Filter elements 20 are provided in the filter base 12 and filter cover 14 for this air filtration process. The filter elements 20, in this embodiment, generally comprise screen elements fixedly mounted to the frames of the filter base 12 and filter cover 14. However, any suitable type of filter elements may be provided. Incoming air can pass through filter elements 20 into the interior of the air filter 10 between the filter base 12 and filter cover 14 and then be allowed to pass through a carburetor inlet aperture 22 in the filter base 12 such that the filtered air can travel to the carburetor.

The filter base 12 generally comprises a frame 24, filter elements 20, carburetor inlet aperture 22 and actuating linkage 26. The filter base frame 24 is generally comprised of a molded material such as a plastic or polymer material. However, any suitable material can be used. The filter elements 20 are fixedly mounted to the frame 24 and, in this embodiment, structural ribs 28 are provided to give form and rigidity to the filter base 12 and to support the filter elements. In this embodiment, suitable holes 30 are provided in the filter base 12 for passage of mounting means (not shown), such as bolts, for mounting the air filter 10 to the carburetor. In this embodiment, the holes 30 are located on opposite sides of the carburetor inlet aperture 22. The actuating linkage 26, in this embodiment, generally comprises a first pivoting member 32, a second pivoting member 34 and a connecting bar 36 mounted therebetween. The first pivoting member 32 and second pivoting member 34 are both movably mounted on the filter base 12 and, because they are connected by the connecting bar 36, in this embodiment, they are only allowed to move or pivot in registry with each other. The first pivoting member 32 is generally connected to a control handle 38 which is intended to be operable by an operator to move the airflow controller 16 between a first position and a second position as will be described in more detail below. The second pivoting member 34 is generally connected to a lever or pivoting arm 40 which is mounted in the interior of the air filter 10 and is connected to the airflow controller 16. An operator, by moving the handle 38 can rotate the first pivoting member 32 which in turn rotates the second pivoting member 34 via the connecting bar 36 which in turn rotates the pivoting arm or lever 40 to move the airflow controller 16. The filter cover 14 is intended to cooperatingly mate with the filter base 12 and substantially prevent air from entering the interior of the air filter 10 except by first passing through the filter elements 20. The filter cover 14 is generally comprised of a molded material such as a plastic or polymer material. However, any suitable material can be used. The filter elements 20 are fixedly mounted to a frame 42 of the cover 14 with structural ribs 44 therebetween. In an alternate embodiment of the invention, the filter elements 20 may be removable. Alternatively, the frames of the filter base 12 and cover 14 may be formed integral with the filter elements 20.

Figure 2:
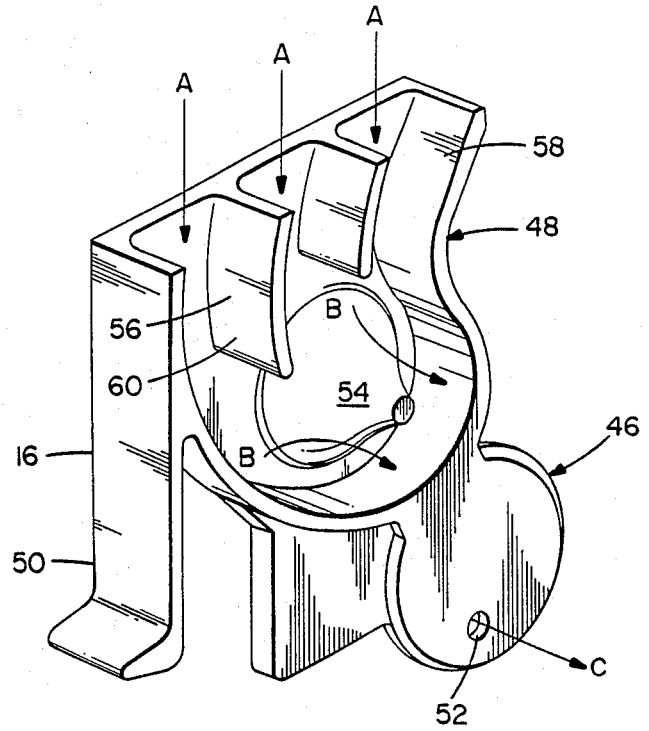
FIG. 2 is a perspective view of an airflow controller of the air filter shown in FIG. 1.

Referring now to FIG. 2, a perspective view of the airflow controller 16 is shown. The airflow controller 16, in this embodiment, is generally comprised of a one piece member formed or molded from a plastic or polymer material. The controller 16, in this embodiment, generally comprises a first section 46, a second section 48 and a resilient arm 50. The airflow controller 16 is generally movable inside the air filter 10 along a relatively coplanar lateral path relative to the filter base 12 and cover 14 between a first position and a second position. The first section 46 of the controller 16 generally comprises a disk shape section suitably sized and shaped such that it can substantially cover the carburetor inlet aperture 22 in the filter base 12 at a first position. The first section 46 also has a choke air inlet aperture 52 for allowing a relatively small amount of inlet air into the carburetor as indicated by arrow C. The second section 48, in this embodiment, generally comprises a cone shaped portion 54 and a volute shaped portion 56. The cone shaped portion 54 is generally alignable with the carburetor inlet aperture 22 in the filter base 12 at a second position. The volute shaped portion 56 generally defines a path for air to flow towards the cone shaped portion 54 as indicated by arrows A and through the carburetor inlet aperture 22 as indicated by arrows B. In this embodiment, the volute shaped portion 56 generally comprises an outer containment wall 58 and inner directional vanes 60. The second section 48 of the air flow controller 16, with the air flow controller 16 at the second position, can generally direct inlet air through the volute shaped portion 56 causing a swirling motion in the inlet air and towards the carburetor inlet aperture 22 via the cone shaped portion 54 and outer directional wall 58. The resilient arm 50, in this embodiment, is generally provided to substantially maintain the airflow controller 16 at a position in the air filter 10 except when an operator actively moves the handle 38 to a choke position as will be described below.

Figure 3C:
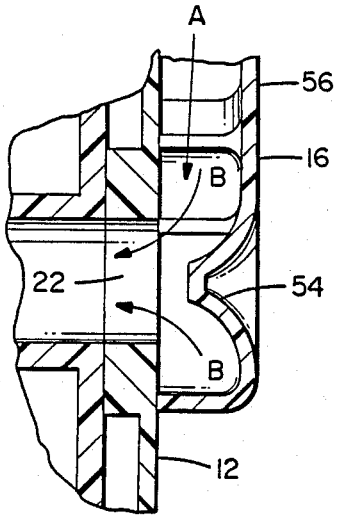
FIG. 3C is a partial cross-sectional side view of the air filter base and airflow controller at the first position.
Figure 3B:
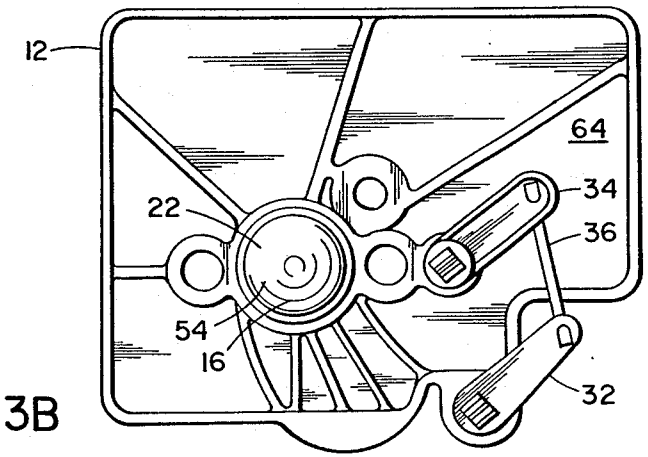
FIG. 3B is a plan view of the outside face of the air filter base with the airflow controller at the first position.
Figure 3A:
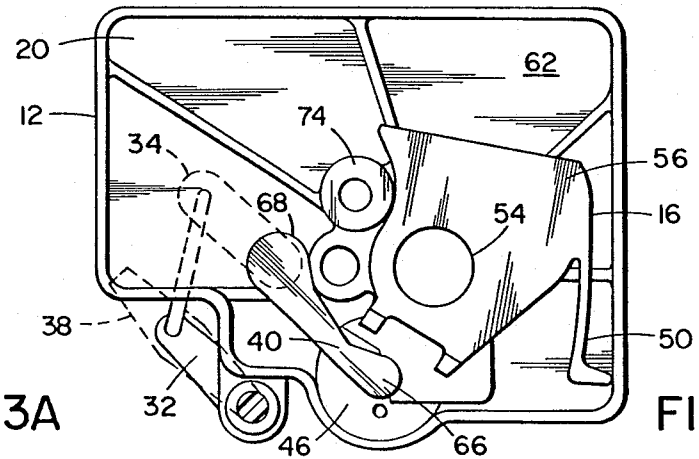
FIG. 3A is a plane view of the airflow controller movably mounted to the inside face of the air filter base at a first position.

Referring now to FIGS. 3A, 3B and 3C, there is shown a plan view of an interior face 62 of the filter base 12 with the air flow controller 16 movably connected thereto at a run position, a plan view of an exterior face 64 of the filter base 12 with the airflow controller 16 in the run position and a partial cross sectional view of the filter base 12 and air flow controller 16 at the run position, respectively. As shown, in this embodiment, the lever 40 has a first end 66 which is connected to the first section 46 of the air flow controller 16 via a pin 70 (see FIG. 1) and a second end 68 which has a portion that extends through an aperture 72 in the filter base 12 and is connected to the second pivoting member 34. In the run position shown, the first section 46 of the airflow controller 16 is substantially offset from the carburetor inlet aperture 22 with the cone shaped portion 54 of the airflow controller 16 being in substantial registry with the aperture 22. A boss 74 is provided between the two covers that generally contacts one side of the controller 16 such that the resilient arm 50 is constantly bent or flexed. The resilient arm 50, being slightly flexed or bent, and the boss 74 substantially maintains or biases the airflow controller 16 at this run position unless an operator, by using the control handle 38, desires to move the airflow controller 16 to another position. The boss 74 and arm 50 also allow the controller 16 to be maintained at a position without risk of movement due to vibrations. In this run position, air which passes through the filter elements 20 into the interior of the air filter 10 is directed via the volute shaped portion 56 of the airflow controller 16 towards the cone shaped portion 54 and hence towards the carburetor inlet aperture 22 for entry into the carburetor. The outer containment wall 58 of the controller 16 substantially defines the inlet air flow path to the carburetor aperture 22. As best shown in FIG. 3C, the airflow controller 16 in the run position basically performs three types of functions. First, the cone shaped portion 54 of the airflow controller substantially covers the carburetor inlet aperture 22 while nonetheless providing a relatively free flow of air therethrough. This allows the airflow controller 16 to act as a fuel spitback shield to collect fuel particles which exit the carburetor through the carburetor inlet aperture 22 during the operation of the engine. The collection of fuel spitback on the airflow controller 16 substantially prevents the fuel from contaminating the filter elements. Second, the cone shaped portion 54 causes a venturi affect on the air flowing into the carburetor. This venturi effect accelerates the velocity of the air flowing around the cone shaped portion and through the carburetor inlet aperture 22 and causes an accelerated atomization of the accumulated fuel spitback on the airflow controller 16. Thus, with the accelerated atomization of the fuel spitback, the rate of return of atomized fuel spitback to the carburetor via the inlet air is equal to, or relatively equal to the rate of fuel spitback accumulation and, hence, accumulated fuel spitback is substantially prevented from contaminating the filter elements. Third, the curved shape of the volute shaped portion 56 causes inlet air to swirl in towards the cone shaped portion 54 to further increase atomization of fuel spitback on the airflow controller 16. In addition, the curved nature of the volute shaped portion 56 provides a greater surface area on the airflow controller 16 for the collection or accumulation of fuel spitback with a diminished risk that the fuel spitback will not be atomized and possibly contaminate the filter elements 20.

Figure 4C:
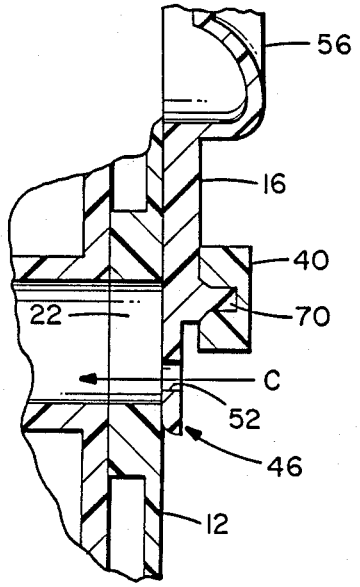
FIG. 4C is a partial cross-sectional side view of the air filter base and airflow controller at the second position.
Figure 4B:
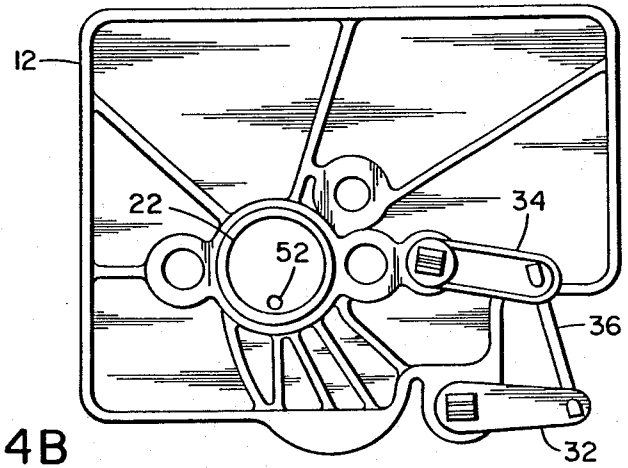
FIG. 4B is a plane view of the outside face of the air filter base with the airflow controller at the second position.
Figure 4A:
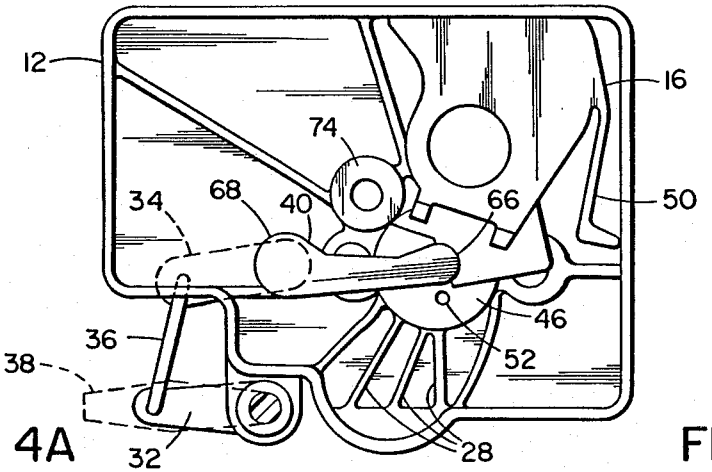
FIG. 4A is a plane view of the airflow controller movably mounted to the inside face of the air filter base at a second position.

Referring now to FIGS. 4A, 4B and 4C, the filter base 12 and airflow controller 16 of FIGS. 3A, 3B and 3C are shown in a choke position, respectively. A comparison of FIG. 4A and 3A shows that the airflow controller 16 has been moved laterally along an arced path relative to the filter base 12. In this choke position, the first section 46 of the airflow controller 16 is positioned over the carburetor inlet aperture 22 such that inlet air from the interior of the air filter 10 can only substantially access the carburetor through the choke inlet air aperture 52. This choke position thus substantially restricts the amount of air that can flow into the carburetor for such purposes as initially starting the engine or alternatively to choke the engine into stopping as known in the art. The resilient arm 50 has sufficient resiliency to bend and, in this embodiment, is orientated relative to the pivot point at the second end 68 of the lever 40 such that the resilient arm 50 will no return the airflow controller 16 to the run position unless the operator, by use of the control handle 38, moves the airflow controller 16 slightly back towards the run position. The resilient arm also maintains the air flow controller in the run position, overcoming vibratory forces. In an alternate embodiment, the resilient arm 50 may be formed such that the choke position must be maintained by the operator at the control handle 38 otherwise the resilient arm 50 will force the airflow controller 16 back towards the run position. In another alternate embodiment, no resilient arm may be incorporated with the invention. Alternatively, any suitable means can be used to bias the airflow controller 16 at any desired position.

As described above, in this embodiment, an operator can generally move the airflow controller 16 in the air filter 10 via the control handle 38. The control handle 38 is connected to the first pivoting member 32. The operator by moving the control handle 38 can pivot the first pivoting member 32 thus moving the connecting bar 36. The connecting bar 36, in turn, can move the second pivoting member 34 such that the second pivoting member 34 causes the lever 40 in the air filter to rotate. The first end 66 of the lever 40, in turn, can move the airflow controller 16 between the run position and the choke position. In this embodiment, the airflow controller 16 can slide along the structural ribs 28 of the filter base 12. Because the airflow controller 16 is mounted in the air filter 10 for relatively coplanar lateral movement therein, the width or thickness of the air filter 10 can be relatively small. In addition, because the airflow controller contains both a means for restricting the airflow into the carburetor and a spitback shield the overall size of the air filter and carburetor can be greatly reduced.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An airflow controller for use in an air filter for an internal combustion engine, the air filter having a carburetor inlet, the airflow controller comprising:

frame means having a first section and a second section, said first section comprising a carburetor inlet restrictor means and said second section comprising means for directing air inflow into the carburetor inlet; and means for movably mounting said frame means in the air filter for relatively lateral movement therein, said frame means being movable in the air filter between a first position having said restrictor means substantially restricting air inflow into the carburetor inlet and a second position having said directing means substantially defining an air inflow path towards the carburetor inlet.

2. An airflow controller as in claim 1 wherein said restrictor means comprises a plate means for substantially covering the carburetor inlet.

3. An airflow controller as in claim 2 wherein said plate means has an aperture means passing therethrough for allowing a reduced amount of air into the carburetor inlet.

4. An airflow controller as in claim 1 wherein said directing means comprises a spitback shield means.

5. An airflow controller as in claim 4 wherein said directing means comprises a venturi cone means that can cooperate with the carburetor inlet to increase the velocity of air into the carburetor inlet.

6. An airflow controller as in claim 5 wherein said directing means comprises an air intake volute means for swirling air towards said venturi cone means.

7. An airflow controller as in claim 6 wherein said venturi cone means and said air intake volute means, at least partially form said spitback shield such that atomization of fuel particles on said spitback shield is relatively fast.

8. An airflow controller as in claim 1 wherein said frame means is comprised of a single element with said first and second sections being relatively stationary to each other.

9. An airflow controller as in claim 1 wherein said mounting means comprises means for slidably moving said frame means in the air filter.

10. An airflow controller as in claim 1 wherein said mounting means comprises a lever means for laterally moving said frame means along an arced path.

11. An airflow controller as in claim 1 further comprising biasing means for, at least partially, returning said frame means from said first position to said second position.

12. An airflow controller as in claim 11 wherein said biasing means comprises a resilient arm extending from said frame means for biasing contact with the air filter.

13. An airflow controller as in claim 10 wherein said lever means is connectable to a handle means for operably moving said frame means between said first and second position.

14. An air filter for use with a carburetor of an internal combustion engine, the filter comprising:

frame means;

filter element means; and airflow controller means movably mounted in said frame means, said controller means comprising means for substantially restricting airflow into the carburetor and a spitback shield means having an air intake volute means and a venturi cone means therewith.

15. An air filter as in claim 14 wherein said frame means comprises a filter base and a filter cover.

16. An air filter as in claim 14 wherein said filter element means comprises filter screens on said frame means.

17. An air filter as in claim 14 wherein said airflow controller means comprises means for laterally moving said controller means in said frame means.

18. An air filter as in claim 17 wherein said controller means is movable along an arced path.

19. An air filter as in claim 14 wherein said restricting means comprises a plate means having an aperture means therethrough.

20. An air filter as in claim 14 wherein said spitback shield means substantially forms an air inlet path to the carburetor with the air being accelerated to an increased veocity for increased atomization of fuel particles.

21. A method of manufacturing an air filter for an internal combustion engine comprising the steps of:

providing a filter frame means connectable to a carburetor of the engine and having an airflow inlet therewith;

providing an airflow controller comprising choke valve means and air inflow channelizer means, said airflow channelizer means comprising a spitback shield having a venturi cone means and an inflow volute; and mounting said airflow controller in said filter frame proximate said airflow inlet such that said airflow controller is movably mounted in said frame means with said choke valve means being movable to choke the engine in a first position.

22. A method as in claim 21 wherein the step of mounting said airflow controller in said filter frame comprises mounting said controller for relatively lateral movement therein.

* * * * *